US011626235B2

(12) United States Patent
Kawamura et al.

(10) Patent No.: US 11,626,235 B2
(45) Date of Patent: Apr. 11, 2023

(54) COIL COMPONENT AND ELECTRONIC DEVICE

(71) Applicant: TAIYO YUDEN CO., LTD., Tokyo (JP)

(72) Inventors: Keizo Kawamura, Takasaki (JP); Jun Ogasawara, Takasaki (JP); Toshimasa Suzuki, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 1133 days.

(21) Appl. No.: 16/221,268

(22) Filed: Dec. 14, 2018

(65) Prior Publication Data

US 2019/0198226 A1 Jun. 27, 2019

(30) Foreign Application Priority Data

Dec. 27, 2017 (JP) ..... JP2017-252520

(51) Int. Cl.

| | |
|---|---|
| ***H01F 27/28*** | (2006.01) |
| ***H01F 27/29*** | (2006.01) |
| ***H01F 3/10*** | (2006.01) |
| ***H01F 17/04*** | (2006.01) |

(52) U.S. Cl.

CPC ..... *H01F 27/2804* (2013.01); *H01F 3/10* (2013.01); *H01F 17/04* (2013.01); *H01F 27/2823* (2013.01); *H01F 27/29* (2013.01); *H01F 27/292* (2013.01); *H01F 2003/106* (2013.01); *H01F 2017/046* (2013.01); *H01F 2017/048* (2013.01)

(58) Field of Classification Search

CPC .. H01F 27/2804; H01F 27/2823; H01F 27/29; H01F 27/292

See application file for complete search history.

(56) References Cited

U.S. PATENT DOCUMENTS

2009/0128275 A1* 5/2009 Yagasaki ..... H01F 17/04 336/83
2010/0328003 A1* 12/2010 Shibuya ..... H01F 17/04 336/90

(Continued)

FOREIGN PATENT DOCUMENTS

JP 2005191403 A * 7/2005
JP 2005191403 A 7/2005

(Continued)

*Primary Examiner* — Elvin G Enad
*Assistant Examiner* — Malcolm Barnes
(74) *Attorney, Agent, or Firm* — Law Office of Katsuhiro Arai

(57) ABSTRACT

In an exemplary embodiment, a coil component includes: an element body part 10 that is formed containing a magnetic material; a coil 40 that is embedded within the element body part 10 and constituted by a wound conductive wire; lead wires 44*a*, 44*b* that are extended from the conductive wire and are led out from the coil 40; and terminal parts 70*a*, 70*b* that are joined to the lead wires 44*a*, 44*b*; wherein tip parts 46*a*, 46*b* of the lead wires 44*a*, 44*b*, each having a prescribed length from the tip, are embedded in the element body part 10 and also extend along the bottom face 22 of the element body part 10, and the terminal parts 70*a*, 70*b* are joined to the tip parts 46*a*, 46*b* of the lead wires 44*a*, 44*b* on the bottom face 22 of the element body part 10.

6 Claims, 7 Drawing Sheets

(56) References Cited

U.S. PATENT DOCUMENTS

| | | | | |
|---|---|---|---|---|
| 2011/0260821 | A1* | 10/2011 | Yamada | H01F 27/292 336/192 |
| 2016/0181014 | A1* | 6/2016 | Watanabe | H01F 27/255 336/83 |
| 2017/0221623 | A1* | 8/2017 | Kawarai | H01F 27/29 |
| 2017/0301451 | A1* | 10/2017 | Kim | H01F 17/04 |

FOREIGN PATENT DOCUMENTS

| | | | | |
|---|---|---|---|---|
| JP | 2009200435 | A | 9/2009 | |
| JP | 2014175437 | A * | 9/2014 | H01M 2/145 |

* cited by examiner

COIL COMPONENT AND ELECTRONIC DEVICE

BACKGROUND

Field of the Invention

The present invention relates to a coil component and an electronic device.

Description of the Related Art

Preferably coil components used in automobiles and industrial machinery have high reliability against vibration. Accordingly, coil components designed to improve vibration reliability are known, wherein metal plates are joined to lead wires that have been led out onto side faces of the element body part, and these metal plates are bent in such a way that they extend from the side faces to the bottom face of the element body part (Patent Literature 1, for example).

In addition, coil components designed to improve the joining strength between lead wires and the terminal parts are known, wherein the terminal parts are embedded in the element body part at least partially, and the lead wires are bent into the element body part and thereby embedded in the element body part (Patent Literature 2, for example).

BACKGROUND ART LITERATURES

[Patent Literature 1] Japanese Patent Laid-open No. 2005-191403

[Patent Literature 2] Japanese Patent Laid-open No. 2009-200435

SUMMARY

In the case of the coil component described in Patent Literature 1, however, the terminal parts, each including the lead wire and the metal plate, are bent in such a way that they extend from the side faces, to the bottom face, of the element body part, and thus are not fixed to the element body part. This means that, when vibration is applied to the coil component in a state where the terminal parts are joined to electrodes on a circuit board, a large force will apply to the area of each lead wire that has been led out onto the exterior of the element body part from the side face of the element body part, and the wire may disconnect in this area.

The present invention was developed in light of the aforementioned problems, and its object is to improve vibration reliability.

Any discussion of problems and solutions involved in the related art has been included in this disclosure solely for the purposes of providing a context for the present invention, and should not be taken as an admission that any or all of the discussion were known at the time the invention was made.

The present invention is a coil component, comprising: an element body part that is formed containing a magnetic material; a coil that is built into the element body part and constituted by a wound conductive wire; lead wires that are extended from the conductive wire and led out from the coil; and terminal parts that are joined to the lead wires; wherein tip parts of the lead wires, each having a prescribed length from the tip, are embedded in the element body part and also extend along a first face among the surfaces of the element body part, and the terminal parts are joined to the tip parts of the lead wires on the first face of the element body part.

The aforementioned constitution may be such that the terminal parts are joined to the sides of the tip parts of the lead wires along the first face of the element body part.

The aforementioned constitution may be such that the lead wires are each constituted by the tip part, and a relay part between the coil and the tip part, and that the tip part and relay part are both embedded in the element body part.

The aforementioned constitution may be such that the relay parts of the lead wires are led out vertically to the first face of the element body part, from the coil toward the first face of the element body part.

The aforementioned constitution may be such that the parts of the terminal parts positioned on the first face of the element body part are embedded in the element body part.

The aforementioned constitution may be such that, on the first face of the element body part, the terminal parts are placed more outwardly than are the tip parts of the lead wires.

The aforementioned constitution may be such that the terminal parts extend from the first face, to a second face that intersects the first face, among the surfaces of the element body part, and are placed on the exterior of the element body part on the second face.

The present invention is an electronic device, comprising: a coil component according to the foregoing; and a circuit board on which the coil component is mounted; wherein the terminal parts of the coil component are joined to electrodes provided on the circuit board.

According to the present invention, vibration reliability can be improved.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1A:
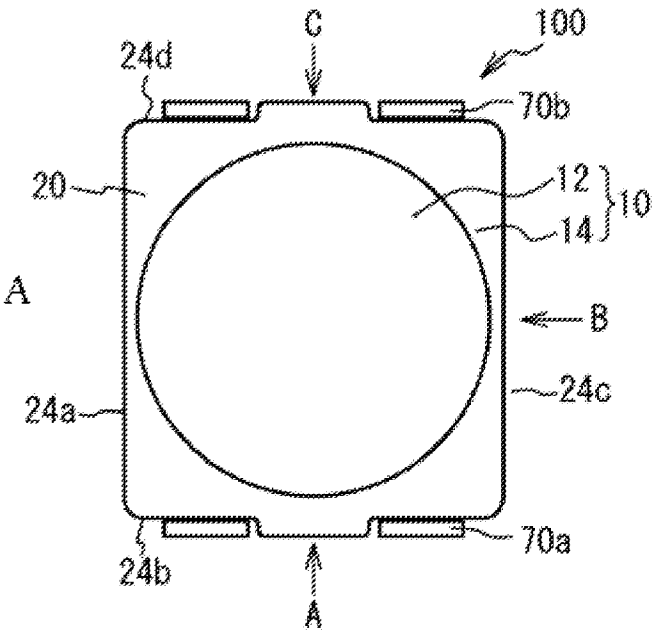
FIG. 1A is a top view.

10 Element body part
12, 14 Magnetic body part
16 Winding shaft
18 Flange part
20 Top face
22 Bottom face
24*a* to 24*d* Side face
26 Concave
40 Coil
44*a*, 44*b* Lead wire
46*a*, 46*b* Tip part
48*a*, 48*b* Relay part
70*a*, 70*b* Terminal part
80 Circuit board
82 Electrode
84 Solder
90*a*, 90*b* Terminal part
92*a*, 92*b* Metal member
94*a*, 94*b* Lead wire
96*a*, 96*b* Area
100, 200 Coil component
300 Electronic device
500 Coil component

DETAILED DESCRIPTION OF EMBODIMENTS

Examples of the present invention are explained below by referring to the drawings.

Example 1

Figure 1B:
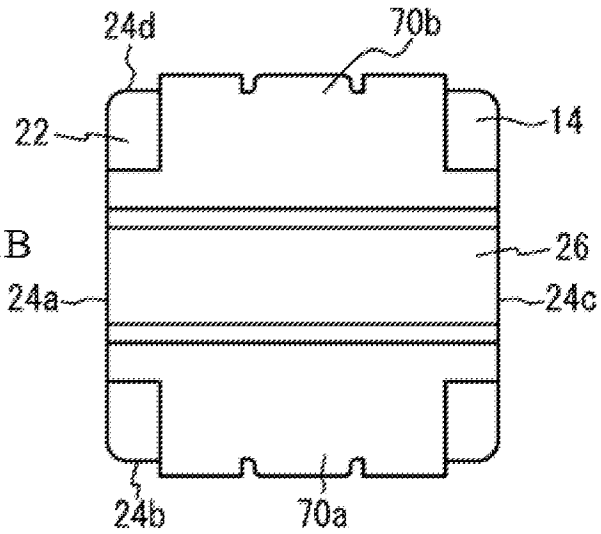
FIG. 1B is a bottom view.
Figure 1C:
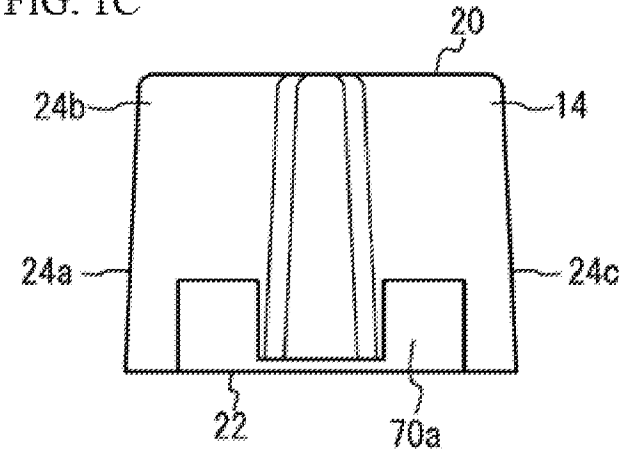
FIGS. 1C and 1D are side views, of the coil component pertaining to Example 1.
Figure 1D:
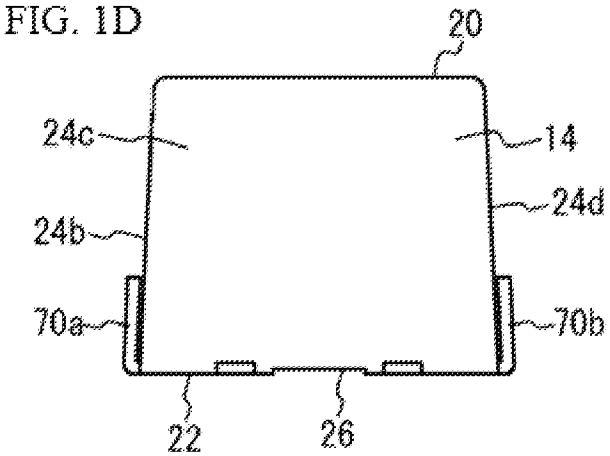
Figure 2A:
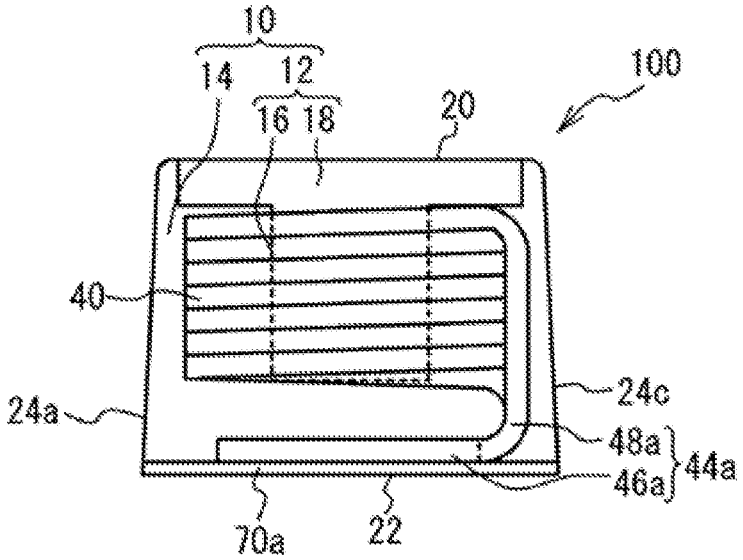
FIGS. 2A to 2C are perspective side views of the interior of the coil component pertaining to Example 1.
Figure 2B:
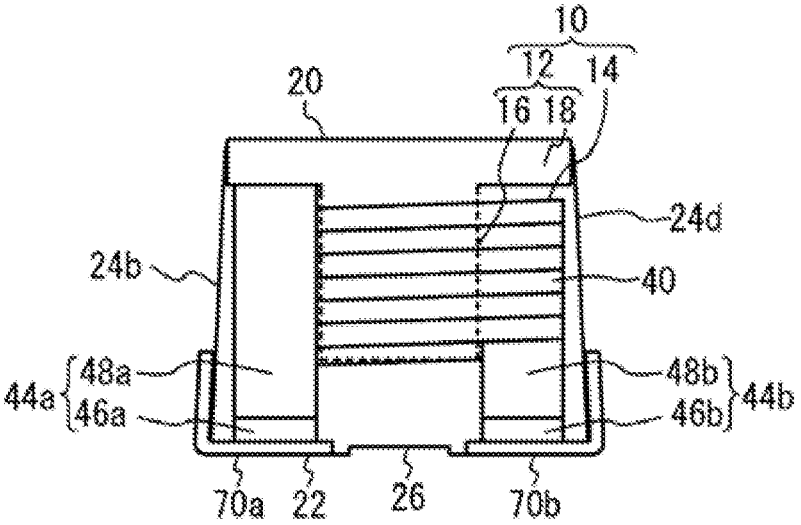
Figure 2C:
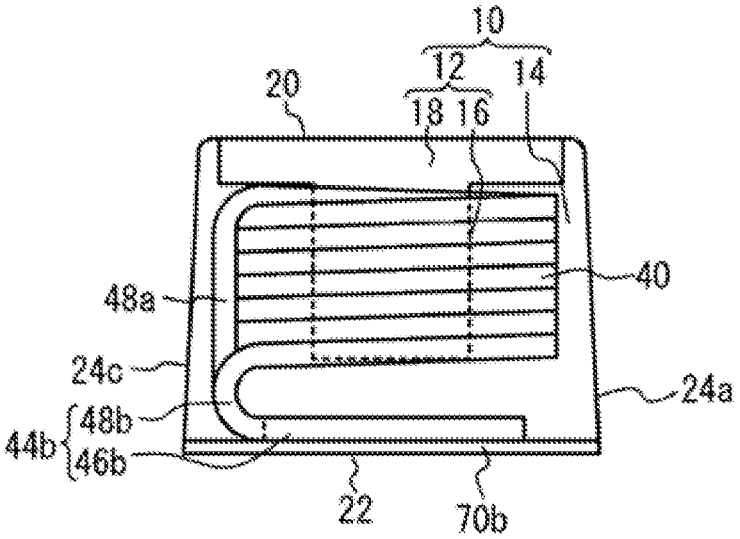
Figure 3A:
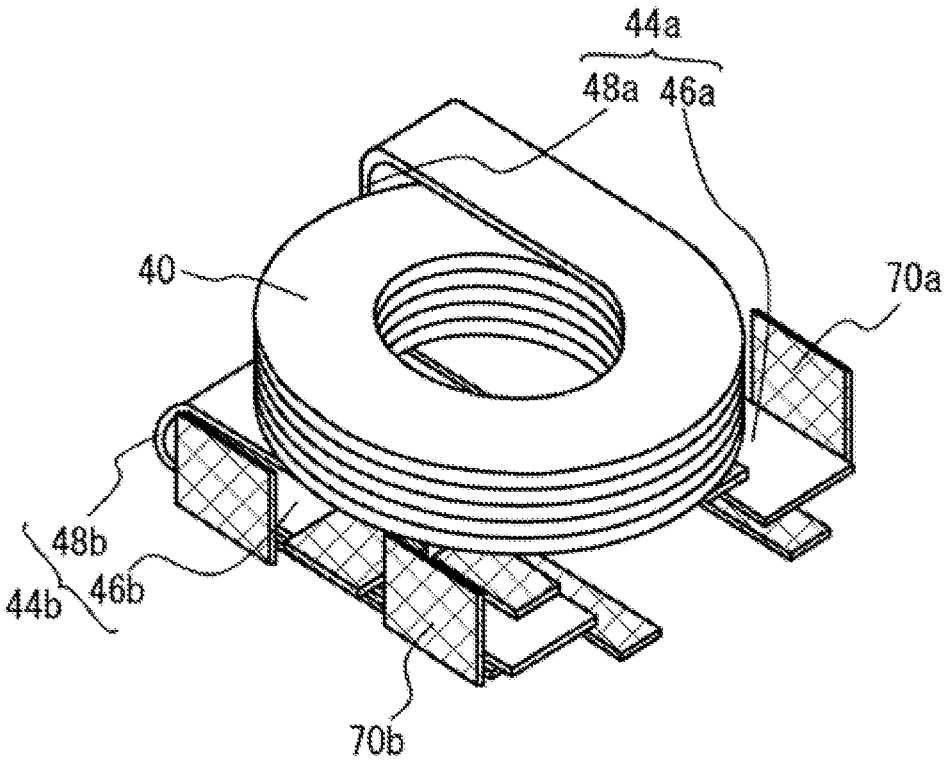
FIGS. 3A and 3B are perspective views of the coil and terminal parts.
Figure 3B:
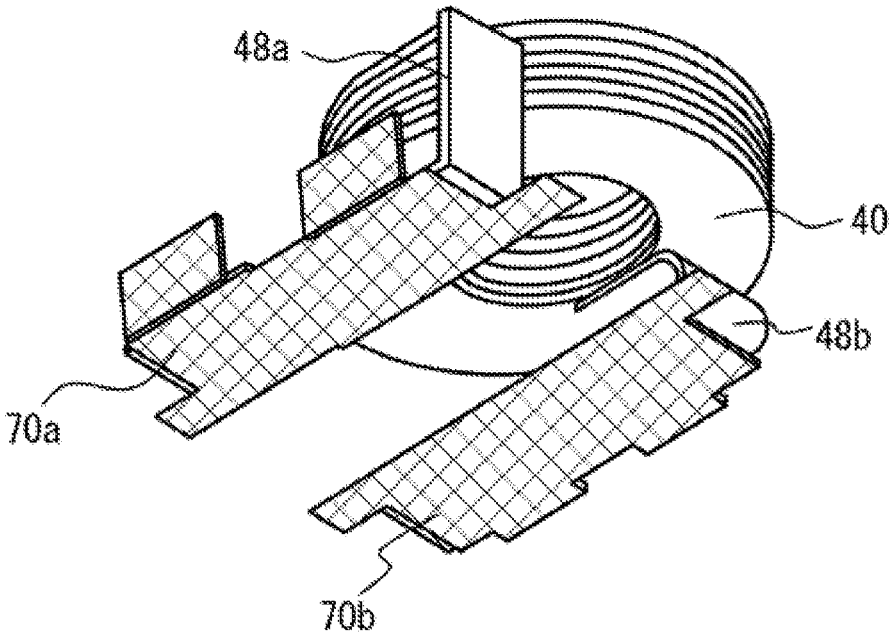

FIG. 1A is a top view, FIG. 1B is a bottom view, and FIGS. 1C and 1D are side views, of the coil component pertaining to Example 1. FIG. 1C is a side view of FIG. 1A from direction A, while FIG. 1D is a side view of FIG. 1A from direction B. FIGS. 2A to 2C are perspective side views of the interior of the coil component pertaining to Example 1. FIG. 2A is a perspective side view of the interior of FIG. 1A from direction A, FIG. 2 (*b*) is a perspective side view of the interior of FIG. 1A from direction B, and FIG. 2C is a perspective side view of the interior of FIG. 1A from direction C. FIGS. 3A and 3B are perspective views of the coil and terminal parts. It should be noted that, in FIGS. 3A and 3B, the terminal parts are cross-hatched for illustrative clarity. As shown in FIGS. 1A to 1D, FIGS. 2A to 2C, and FIGS. 3A and 3B, the coil component 100 in Example 1 comprises an element body part 10, a coil 40, lead wires 44*a*, 44*b*, and terminal parts 70*a*, 70*b*.

The element body part 10 is formed containing a magnetic material, and constituted by magnetic bodies 12, 14, each having a different magnetic permeability. For example, the magnetic permeability of the magnetic body part 12 is higher than the magnetic permeability of the magnetic body part 14. The magnetic body part 12 includes a winding shaft 16, and a flange part 18 provided at one end of the winding shaft 16 in the axial direction. The winding shaft 16 has a columnar shape, for example, while the flange part 18 has a disk shape having a thickness in the axial direction of the winding shaft 16, for example.

The magnetic body part 12 is formed by a ferrite material, magnetic metal material, or a resin containing magnetic metal grains, for example. For example, the magnetic body part 12 is formed by Ni—Zn, Mn—Zn, or other ferrite, Fe—Si—Cr, Fe—Si—Al, Fe—Si—Cr—Al, or other soft magnetic alloy, Fe, Ni, or other magnetic metal, amorphous magnetic metal, nanocrystal magnetic metal, or a resin containing magnetic metal grains. If the magnetic body part 12 is formed by a soft magnetic alloy, magnetic metal, amorphous magnetic metal, or nanocrystal magnetic metal, the constituent grains thereof may be insulated.

The magnetic body part 14 is formed by a resin containing magnetic metal grains, for example, but it may also be formed by a ferrite material or magnetic metal material.

The element body part 10 has a square pyramid shape, for example. The top face 20 of the element body part 10 has a length per side of approx. 3.8 mm, for example, and is shaped as a square with rounded corners. The bottom face 22 of the element body part 10 has a length per side of approx. 4.1 mm, for example, and is shaped as a square with rounded corners. The height (length between the top face 20 and the bottom face 22) of the element body part 10 is approx. 3.0 mm, for example. The bottom face 22 is a mounting surface to be mounted on a circuit board, while the top face 20 is the face on the opposite side of the bottom face 22. The faces connected to the bottom face 22 and top face 20 are side faces 24*a* to 24*d*.

The coil 40 is formed by a conductive wire being wound around the winding shaft 16 of the magnetic body part 12. Both ends of this conductive wire are led out from the coil 40 to become a pair of lead wires 44*a*, 44*b*. The conductive wire is a metal wire whose surface is covered with an insulating sheath, for example. The material for the metal wire may be copper, copper alloy, silver, or palladium, for example. The material for the insulting film may be polyester imide or polyamide, for example. The coil 40 is, for example, but not limited to, an edgewise-wound conductive wire being a rectangular wire having a rectangular cross-sectional shape. The conductive wire may be a round wire, etc., having a circular shape, while the coil 40 may be wound by other winding method such as alpha-winding.

The coil 40 is built into the element body part 10 and not exposed to the exterior of the element body part 10. The lead wires 44*a*, 44*b* are led out from the coil 40 toward the bottom face 22 of the element body part 10 inside the element body part 10, and bent near the bottom face 22 of the element body part 10 so that they run in parallel with the bottom face 22. As a result, a tip part 46*a* of the lead wire 44*a* having a prescribed length from the tip, and a tip part 46*b* of the lead wire 44*b* having a prescribed length from the tip, extend along the bottom face 22 in parallel with the bottom face 22 of the element body part 10. The tip part 46*a* of the lead wire 44*a*, and the tip part 46*b* of the lead wire 44*b*, are embedded in the element body part 10. It should be noted that "the tip parts 46*a*, 46*b* are embedded in the element body part 10" does not only mean the tip parts 46*a*, 46*b* are entirely and completely embedded in the element body part 10, but it also means they are embedded in the element body part 10 while partially exposed onto or projecting from the element body part 10. "In parallel" does not only mean the tip part 46*a* of the lead wire 44*a*, and the tip part 46*b* of the lead wire 44*b*, are completely parallel with the bottom face 22 of the element body part 10. It also includes situations where parallelism has shifted by a manufacturing error or the like, such as cases of approximate parallelism where the tip part 46*a* of the lead wire 44*a*, and the tip part 46*b* of the lead wire 44*b*, are angled by no more than 10° with respect to the bottom face 22 of the element body part 10.

Of the lead wire 44*a*, a relay part 48*a* between the coil 40 and the tip part 46*a* is led out vertically to the bottom face 22 of the element body part 10, from the position at the end of winding of the coil 40 toward the bottom face 22 of the element body part 10. Of the lead wire 44*b*, a relay part 48*b* between the coil 40 and the tip part 46*b* is folded back and bent onto the bottom face 22 of the element body part 10 from the position at the end of winding of the coil 40. It should be noted that, in FIG. 2C, the relay part 48*b* of the lead wire 44*b* is short and thus virtually no part of it led out from the coil 40 vertically to the bottom face 22 of the element body part 10; if long, however, preferably this part is led out from the coil 40 vertically to the bottom face 22 of the element body part 10. It should be noted that "vertically" does not only mean the relay part 48*a* of the lead wire 44*a*, and the relay part 48*b* of the lead wire 44*b*, are 90° with respect to the bottom face 22 of the element body part 10. It also includes situations where 90° verticality has shifted by a manufacturing error or the like, such as cases of approximate verticality corresponding to 80° to 100° with respect to the bottom face 22 of the element body part 10.

The relay part 48*a* of the lead wire 44*a*, and the relay part 48*b* of the lead wire 44*b*, are embedded in the element body part 10. It should be noted that "the relay parts 48*a*, 48*b* are embedded in the element body part 10" does not only mean the relay parts 48*a*, 48*b* are entirely and completely embedded in the element body part 10, but it also means they are embedded in the element body part 10 while partially exposed to or projecting from the element body part 10. The lead wire 44*a* is not led out to the exterior of the element body part 10 because the tip part 46*a* and relay part 48*a* are embedded in the element body part 10. Similarly, the lead wire 44*b* is not led out to the exterior of the element body part 10 because the tip part 46*b* and relay part 48*b* are embedded in the element body part 10.

The terminal parts 70*a*, 70*b* are constituted by plate-like metal members and embedded under the bottom face 22 of the element body part 10, where the terminal part 70*a* is bent onto the side face 24*b* of the element body part 10, while the terminal part 70*b* is bent onto the side face 24*d* of the element body part 10. It should be noted that "the terminal parts 70*a*, 70*b* are embedded in the element body part 10" includes situations where the terminal parts 70*a*, 70*b* are embedded under a condition that their undersides are exposed from the bottom face 22 of the element body part 10. So long as this condition is met, the terminal parts 70*a*, 70*b* may be entirely or partially embedded in the element body part 10 except for the undersides. The undersides of the terminal parts 70*a*, 70*b* are flush with the bottom face 22 of the element body part 10, for example. On the bottom face 22 of the element body part 10, a concave 26 is formed in the area positioned between the terminal parts 70*a*, 70*b*. The part of the terminal part 70*a* bent onto the side face 24*b* of the element body part 10, and the part of the terminal part 70*b* bent onto the side face 24*d* of the element body part 10, are not embedded in the element body part 10 but are placed on the exterior of the element body part 10.

Preferably the terminal parts 70*a*, 70*b* are formed by a material having high electrical conductivity and high mechanical rigidity; for example, it is formed by a copper plate, copper alloy plate, etc., of approx. 0.02 mm to 0.2 mm in thickness. The terminal parts 70*a*, 70*b* may have a layer formed on the surface by plating, sputtering, or otherwise applying nickel and/or tin, etc.

The terminal part 70*a* is joined to the tip part 46*a* of the lead wire 44*a* on the bottom face 22 of the element body part 10. For example, the terminal part 70*a* is joined to the side face, on the bottom face 22 side of the element body part 10, of the tip part 46*a* of the lead wire 44*a*. Similarly, the terminal part 70*b* is joined to the tip part 46*b* of the lead wire 44*b* on the bottom face 22 of the element body part 10. For example, the terminal part 70*b* is joined to the side face, on the bottom face 22 side of the element body part 10, of the tip part 46*b* of the lead wire 44*b*. For the joining of the lead wire 44*a* and the terminal part 70*a*, and also for the joining of the lead wire 44*b* and the terminal part 70*b*, any generally known method for joining metals, such as solder joining, laser welding, pressure bonding, ultrasonic joining, etc., may be used.

The tip part 46*a* of the lead wire 44*a*, and the part of the terminal part 70*a* positioned on the bottom face 22 of the element body part 10, are embedded in the element body part 10; accordingly, the part where the lead wire 44*a* and terminal part 70*a* are joined is embedded in the element body part 10. Similarly, the tip part 46*b* of the lead wire 44*b*, and the part of the terminal part 70*b* positioned on the bottom face 22 of the element body part 10, are embedded in the element body part 10; accordingly, the part where the lead wire 44*b* and terminal part 70*b* are joined is embedded in the element body part 10.

On the bottom face 22 of the element body part 10, the terminal part 70*a* is placed more outwardly than is the tip part 46*a* of the lead wire 44*a*, while the terminal part 70*b* is placed more outwardly than is the tip part 46*b* of the lead wire 44*b*.

Next, the method for manufacturing the coil component 100 in Example 1 is explained. First, a conductive wire being a rectangular wire is edgewise-wound to form a coil 40, and two lead wires 44*a*, 44*b* of appropriate lengths that are running straight and roughly in parallel, are led out from the coil 40. Next, the insulating sheath is stripped from the tip part 46*a* of the lead wire 44*a*, and from the tip part 46*b* of the lead wire 44*b*. The insulating sheath may be stripped by irradiating laser beam, for example, but it may also be stripped using a cutting knife or chemical agent.

Next, a forming process is performed to bend the lead wires 44*a*, 44*b*. After the forming process, the lead wires 44*a*, 44*b* have relay parts 48*a*, 48*b* formed by bending the coil 40, as well as tip parts 46*a*, 46*b* formed by bending the relay parts 48*a*, 48*b*, respectively.

Next, a terminal part 70*a* constituted by a tabular metal member is joined to the tip part 46*a* of the lead wire 44*a*, and a terminal part 70*b* constituted by a tabular metal member is joined to the tip part 46*b* of the lead wire 44*b*. The terminal parts 70*a*, 70*b* may be joined by means of solder joining, laser welding, pressure bonding, ultrasonic joining, etc., for example.

Next, a magnetic body part 12 having a winding shaft 16 and a flange part 18 is installed to the coil 40 in such a way that the winding shaft 16 is inserted into the hollow part of the coil 40. At this time, the flange part 18 is positioned on the opposite side, to the terminal parts 70*a*, 70*b*, of the coil 40.

Next, the coil 40 to which the magnetic body part 12 has been installed is placed inside a die. Then, a liquid resin containing magnetic metal grains is poured and filled, at a prescribed pressure, into the die using a dispenser, etc. Next, the liquid resin that has been filled into the die is dried under prescribed drying conditions, and then cured under prescribed curing conditions, to form a magnetic body part 14. Since the terminal parts 70*a*, 70*b* were joined to the lead wires 44*a*, 44*b* before the forming of the magnetic body part 14, as described above, the lead wires 44*a*, 44*b* and terminal parts 70*a*, 70*b* are embedded in the element body part 10 constituted by the magnetic bodies 12, 14. In addition, the undersides of the terminal parts 70*a*, 70*b* become flush with the bottom face 22 of the element body part 10. It should be noted that, although Example 1 illustrates an example where the terminal parts 70*a*, 70*b* are each formed by a single metal plate, the present invention is not limited to this. The terminal parts 70*a*, 70*b* may each be formed by a combination of multiple metal plates.

Next, the element body part 10 with the built-in coil 40 is removed from the die and the terminal parts 70*a*, 70*b* are bent onto the side faces 24*a* to 24*d* of the element body part 10. This way, the coil component 100 in Example 1 is formed.

Figure 4:
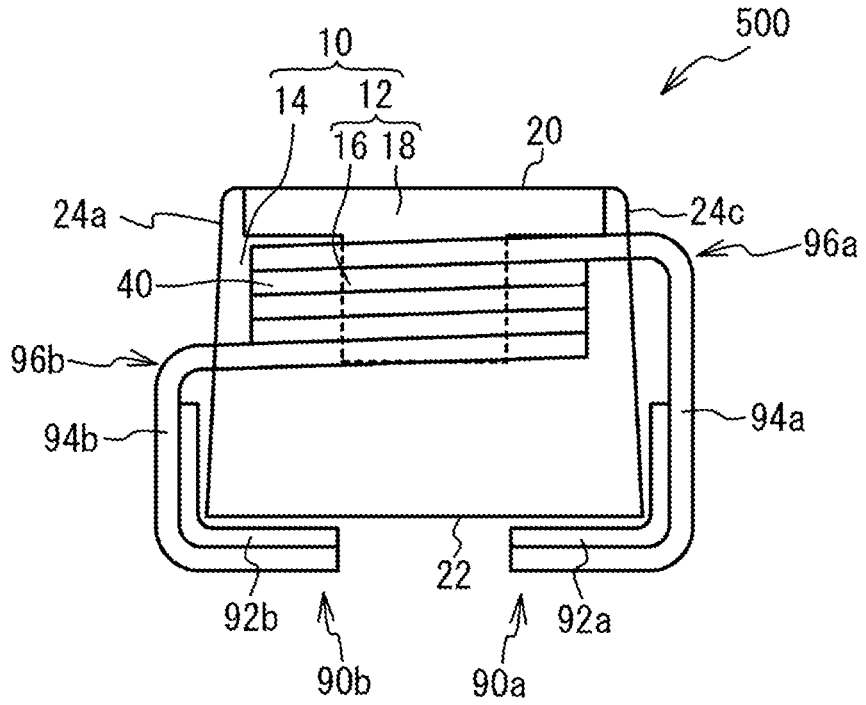
FIG. 4 is a perspective side view of the interior of the coil component pertaining to Comparative Example 1.

Before explaining the effects of the coil component 100 in Example 1, the coil components provided as comparative examples are explained. FIG. 4 is a perspective side view of the interior of the coil component pertaining to Comparative Example 1. As shown in FIG. 4, the coil component 500 in Comparative Example 1 is such that a lead wire 94*a* is led out from a side face 24*c* of an element body part 10 onto the exterior of the element body part 10, while a lead wire 94*b* is led out from a side face 24*a* of the element body part 10 onto the exterior of the element body part 10. Joined to the lead wire 94*a* is a plate-like metal member 92*a* so that it is positioned between the element body part 10 and the lead wire 94*a*, while joined to the lead wire 94*b* is a plate-like metal member 92*b* so that it is positioned between the element body part 10 and the lead wire 94*b*. The lead wire 94*a* and metal member 92*a* are bent in a manner extending on the exterior of the element body part 10 along the bottom face 22 from the side face 24*c*, to constitute a terminal part 90*a*. The lead wire 94*b* and metal member 92*b* are bent in a manner extending on the exterior of the element body part 10 along the bottom face 22 from the side face 24*a*, to constitute a terminal part 90*b*. The terminal parts 90*a*, 90*b* are not fixed to the element body part 10. The terminal parts 90*a*, 90*b* are not fixed to the element body part 10 partly to eliminate the need to consider the heat resistance of the adhesive otherwise used to fix them, and partly in consideration of the effect of stacking three layers, including the element body part 10, metal member 92*a* or 92*b* and adhesive, each having a different coefficient of thermal expansion. In Example 1, too, preferably the effect of the difference between the coefficient of thermal expansion of the element body part 10 and that of the terminal parts 70*a*, 70*b* is considered; here, however, Comparative Example 1 provides a three-layer structure, while Example 1 provides a two-layer structure which allows for reduction of the effect of different coefficients of thermal expansion. The remaining constitutions are the same as those in Example 1 and therefore not explained.

Figure 5:
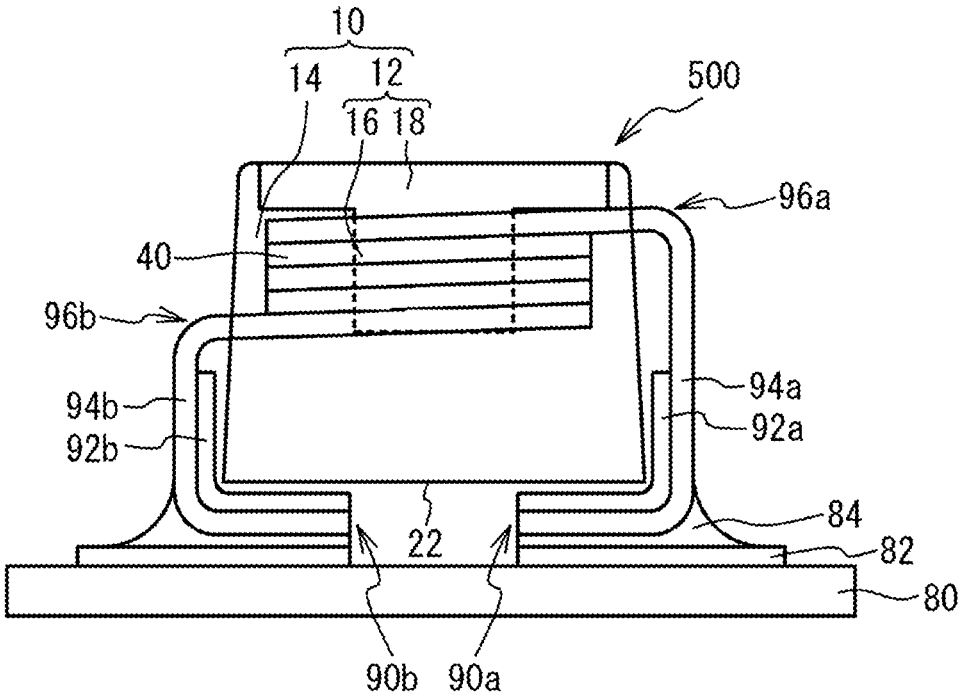
FIG. 5 is a drawing explaining the problems that occur in the coil component pertaining to Comparative Example 1.

FIG. 5 is a drawing explaining the problems that occur in the coil component pertaining to Comparative Example 1. As shown in FIG. 5, the coil component 500 in Comparative Example 1 is mounted on a circuit board 80 as a result of the terminal parts 90*a*, 90*b* of the coil component 500 joined to the electrodes 82 on the circuit board 80 by means of a solder 84. In this case, the terminal parts 90*a*, 90*b* are joined to the circuit board 80 on the bottom face 22 side of the element body part 10, but not fixed to the element body part 10 on the bottom face 22 of the element body part 10. This means that the coil component 500 is suspended over the circuit board 80 in such a way that the areas 96*a*, 96*b* where the lead wires 94*a*, 94*b* are led out from the element body part 10 act as fulcrums. As a result, an application of vibration to the coil component 500 causes the areas 96*a*, 96*b* where the lead wires 94*a*, 94*b* are led out from the element body part 10 to receive a large force. As the areas 96*a*, 96*b* receive this large force, disconnection may occur in the areas 96*a*, 96*b*. If the coil component 500 is used in an automobile, industrial machinery, etc., for example, the coil component 500 is often subject to vibration and thus the lead wires 94*a*, 94*b* may receive large forces and eventually disconnect in the areas 96*a*, 96*b* where they are led out from the element body part 10. Furthermore, because the coil component 500 is suspended over the circuit board 80 in such a way that the areas 96*a*, 96*b* where the lead wires 94*a*, 94*b* are led out from the element body part 10 act as fulcrums, it has a certain resonance frequency of vibration. Vibration resistance tests required for automotive applications, etc., involve testing at various vibration frequencies, and the test vibration waves also contain harmonic components. Accordingly, the coil component 500 may resonate in these vibration tests, in which case the lead wires 94*a*, 94*b* may receive even larger forces, and eventually disconnect, near the areas 96*a*, 96*b* where they are led out from the element body part 10.

According to Example 1, on the other hand, the tip part 46*a* of the lead wire 44*a*, and the tip part 46*b* of the lead wire 44*b*, are embedded in the element body part 10 and also extend along the bottom face 22 of the element body part 10, as shown in FIGS. 2A to 2C. And, the terminal part 70*a* is joined to the tip part 46*a* of the lead wire 44*a* on the bottom face 22 of the element body part 10, while the terminal part 70*b* is joined to the tip part 46*b* of the lead wire 44*b* on the bottom face 22 of the element body part 10. Since the tip part 46*a* of the lead wire 44*a* joined to the terminal part 70*a*, and the tip part 46*b* of the lead wire 44*b* joined to the terminal part 70*b*, are embedded in the element body part 10, as described above, the coil component 100 does not suspend over the circuit board by the lead wires 44*a*, 44*b*. This means that, even when vibration is applied to the coil component 100 with its terminal parts 70*a*, 70*b* joined to the electrodes on the circuit board, the areas of the lead wires 44*a*, 44*b* to which large forces may be applied can be eliminated. As a result, disconnection of the lead wires 44*a*, 44*b* can be reduced, which in turn improves vibration reliability.

As shown in FIGS. 2A to 2C, preferably the terminal part 70*a* is joined to the side, along the bottom face 22 of the element body part 10, of the tip part 46*a* of the lead wire 44*a*, while the terminal part 70*b* is joined to the side, along the bottom face 22 of the element body part 10, of the tip part 46*b* of the lead wire 44*b*. This way, the area over which the terminal part 70*a* is joined with the lead wire 44*a*, and the area over which the terminal part 70*b* is joined with the lead wire 44*b*, can be increased, which in turn improves the joining strength. In addition, preferably the tip part 46*a* of the lead wire 44*a* is joined to the terminal part 70*a* only on the side positioned on the bottom face 22 side of the element body part 10. Similarly, preferably the tip part 46*b* of the lead wire 44*b* is joined to the terminal part 70*b* only on the side positioned on the bottom face 22 side of the element body part 10. In other words, the tip part 46*a* of the lead wire 44*a* is joined to the terminal part 70*a* only in one direction, while the tip part 46*b* of the lead wire 44*b* is joined to the terminal part 70*b* only in one direction. This way, the space needed to join the lead wire 44*a* and the terminal part 70*a*, and the space needed to join the lead wire 44*b* and the terminal part 70*b*, can be reduced and consequently the coil component 100 can be made smaller.

As shown in FIGS. 2A to 2C, preferably the tip part 46*a* and relay part 48*a* constituting the lead wire 44*a* are both embedded in the element body part 10. Similarly, preferably the tip part 46*b* and relay part 48*b* constituting the lead wire 44*b* are both embedded in the element body part 10. This way, vibration reliability can be improved further. In addition, the coil component 100 can be made smaller compared to when the lead wires 44*a*, 44*b* are led out to the exterior of the element body part 10.

As shown in FIGS. 2A to 2C, preferably the relay part 48*a* of the lead wire 44*a* is led out vertically to the bottom face 22 of the element body part 10, from the coil 40 toward the bottom face 22 of the element body part 10. This way, the coil component 100 can be made smaller. It should be noted that, if the relay part 48*b* of the lead wire 44*b* is long, then preferably the relay part 48*b* is led out vertically to the bottom face 22 of the element body part 10, from the coil 40 toward the bottom face 22 of the element body part 10, just like the relay part 48*a*.

As shown in FIGS. 2A to 2C, preferably the relay part 48*a* of the lead wire 44*a* is led out vertically to the bottom face 22 of the element body part 10, from the position at the end of winding of the coil 40 toward the bottom face 22 of the element body part 10. This way, the length of the lead wire 44*a* can be shortened, which in turn keeps the electrical resistance low. In addition, vibration reliability can be improved compared to when the lead wire 44*a* has a part which is led out toward a side face of the element body part 10. It should be noted that, if the relay part 48*b* of the lead wire 44*b* is long, then preferably the relay part 48*b* is led out vertically to the bottom face 22 of the element body part 10, from the position at the end of winding of the coil 40 toward the bottom face 22 of the element body part 10, just like the relay part 48*a*.

When the interior of the element body part 10 is viewed perspectively from the top face 20 side, preferably the coil 40 and lead wires 44*a*, 44*b* are positioned on the inner side of the terminal parts 70*a*, 70*b* instead of projecting outward beyond the terminal parts 70*a*, 70*b*. This way, the coil component 100 can be made smaller.

As shown in FIGS. 1A to 1D and FIGS. 2A to 2C, preferably the parts of the terminal parts 70*a*, 70*b* positioned on the bottom face 22 of the element body part 10 are embedded in the element body part 10. This way, vibration reliability can be improved further. From the viewpoint of improving vibration reliability, preferably the terminal parts 70*a*, 70*b* are embedded in the element body part 10 in their entirety, except for the undersides of the parts positioned on the bottom face 22 of the element body part 10; if the terminal parts 70*a*, 70*b* have a plated layer on their undersides, for example, preferably all parts of them are embedded in the element body part 10, except for the plated layer on their undersides.

As shown in FIG. 2A to 2C, preferably on the bottom face 22 of the element body part 10, the terminal part 70*a* is placed more outwardly than is the tip part 46*a* of the lead wire 44*a*, while the terminal part 70*b* is placed more outwardly than is the tip part 46*b* of the lead wire 44*b*. This way, the undersides of the terminal parts 70*a*, 70*b* become smooth surfaces. The undersides of the terminal parts 70*a*, 70*b* are surfaces to which a solder is applied when the coil component 100 is mounted on a circuit board, and as these undersides provide smooth surfaces on which the lead wires 44*a*, 44*b* whose material is different from that of the terminal parts 70*a*, 70*b* are not provided, uniform solder wettability can be achieved.

As shown in FIGS. 1A to 1D and FIGS. 2A to 2C, preferably the terminal part 70*a* extends from the bottom face 22, to the side face 24*b*, of the element body part 10 and, on the side face 24*b* of the element body part 10, it is positioned on the exterior of the element body part 10. Similarly, preferably the terminal part 70*b* extends from the bottom face 22, to the side face 24*d*, of the element body part 10 and, on the side face 24*d* of the element body part 10, it is positioned on the exterior of the element body part 10. This way, a solder fillet is formed, when the coil component 100 is mounted on a circuit board, at the part of the terminal part 70*a* being bent onto the side face 24*b* of the element body part 10, and also at the part of the terminal part 70*b* being bent onto the side face 24*d* of the element body part 10.

Figure 6A:
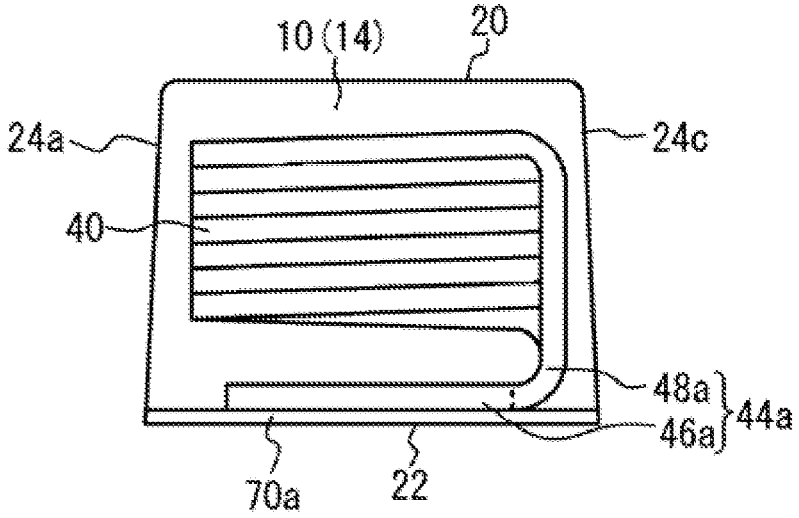
FIGS. 6A and 6B are perspective side views of the interior of the coil component pertaining to Variation Example 1 of Example 1.
Figure 6B:
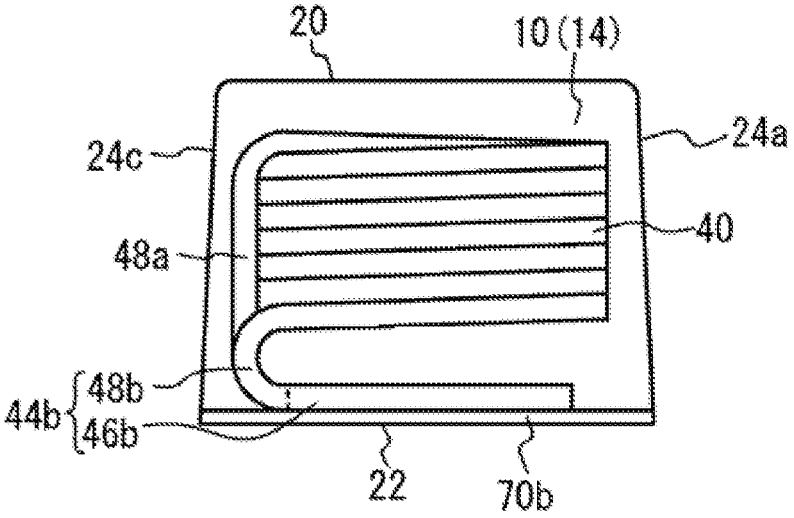

Although Example 1 illustrated an example where the element body part 10 is constituted by the magnetic body part 12 and magnetic body part 14, the present invention is not limited to this. FIGS. 6A and 6B are perspective side views of the interior of the coil component pertaining to Variation Example 1 of Example 1. As shown in FIGS. 6A and 6B, the element body part 10 may not have the magnetic body part 12; instead, it may be constituted only by the magnetic body part 14, in which this magnetic body part 14 is provided where the magnetic body part 12 is provided in Example 1. However, the inductance and other electrical properties can be improved by using the magnetic body part 12 whose magnetic permeability is higher than that of the magnetic body part 14, and therefore preferably the element body part 10 is constituted by the magnetic body part 12 and magnetic body part 14.

Although Example 1 illustrated an example where the magnetic body part 12 has a T shape comprising the winding shaft 16 and the flange part 18 provided at one end of the winding shaft 16, it may also have an I shape comprising the winding shaft 16 and flange parts 18 provided at both ends of the winding shaft 16. If the magnetic body part 12 has an I shape, however, the lead wires 44*a*, 44*b* are positioned on the outer side of the flange parts 18 of the magnetic body part 12, which reduces the effect of improving the electrical properties. Accordingly, preferably the magnetic body part 12 has a T shape and the flange part 18 is positioned on the opposite side, to the side on which the lead wires 44*a*, 44*b* are led out, of the coil 40. Also, from the viewpoint of improving the electrical properties, preferably the flange part 18 of the T-shaped magnetic body part 12 is exposed on the top face 20 of the element body part 10.

Example 2

Figure 7A:
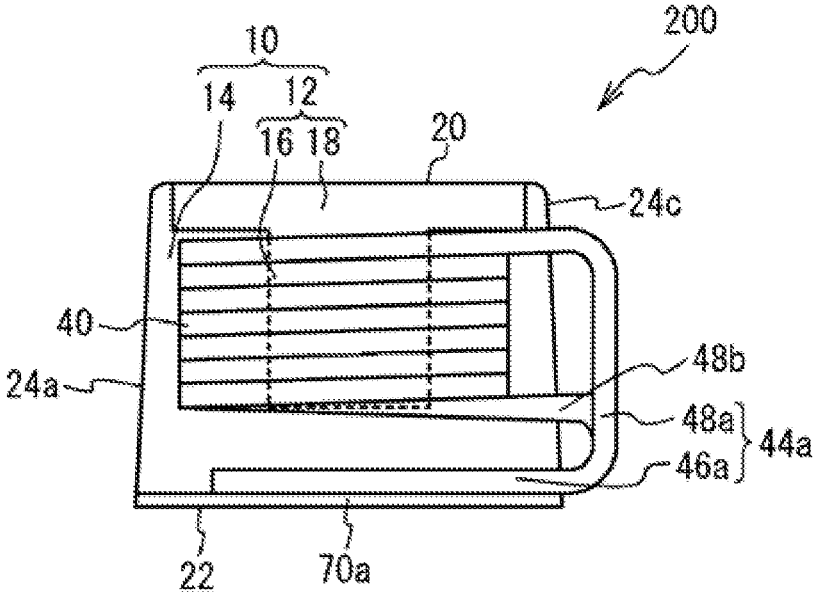
FIGS. 7A and 7B are perspective side views of the interior of the coil component pertaining to Example 2.
Figure 7B:
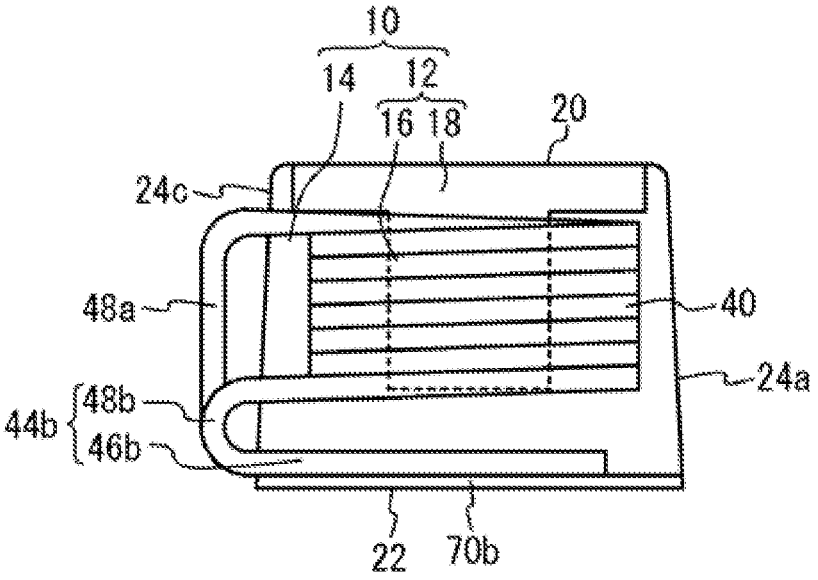

FIGS. 7A and 7B are perspective side views of the interior of the coil component pertaining to Example 2. As shown in FIGS. 7A and 7B, the coil component 200 in Example 2 is such that the relay part 48*a* of the lead wire 44*a*, and the relay part 48*b* of the lead wire 44*b*, are led out from the side face 24*c* of the element body part 10 to the exterior of the element body part 10. The relay part 48*a* of the lead wire 44*a*, and the relay part 48*b* of the lead wire 44*b*, are bent on the exterior of the element body part 10, while the tip part 46*a* of the lead wire 44*a*, and the tip part 46*b* of the lead wire 44*b*, are embedded in the element body part 10 and also extend along the bottom face 22 of the element body part 10. The remaining constitutions are the same as those in Example 1 and therefore not explained.

As shown in Example 2, the relay part 48*a* of the lead wire 44*a*, and the relay part 48*b* of the lead wire 44*b*, may be led out to the exterior of the element body part 10. In this case, vibration reliability can still be improved because the tip part 46*a* of the lead wire 44*a*, and the tip part 46*b* of the lead wire 44*b*, are embedded in the element body part 10.

Example 3

Figure 8A:
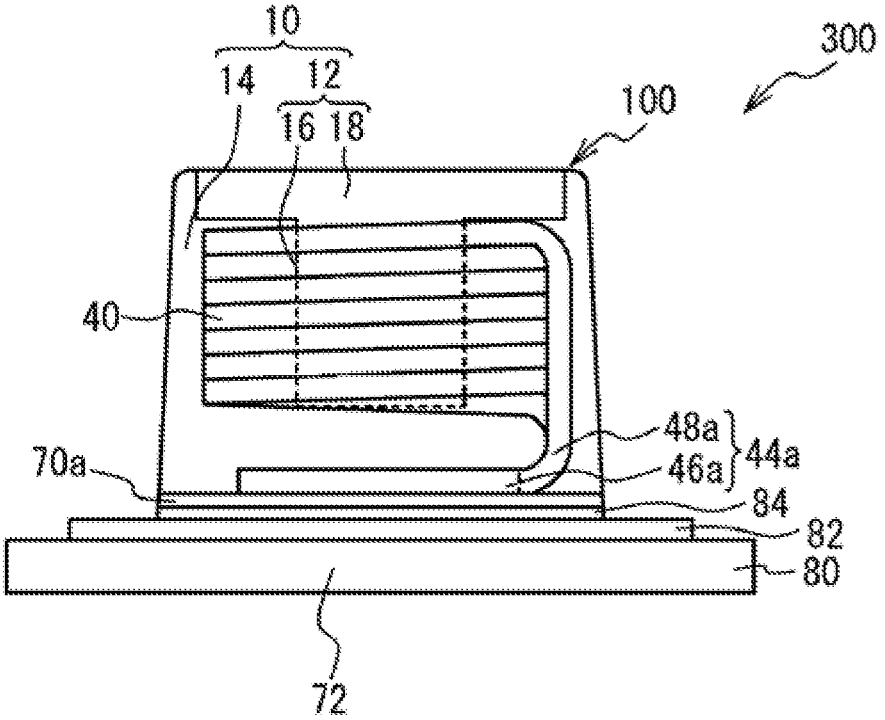
FIGS. 8A and 8B are perspective side views of the interior of the electronic device pertaining to Example 3.
Figure 8B:
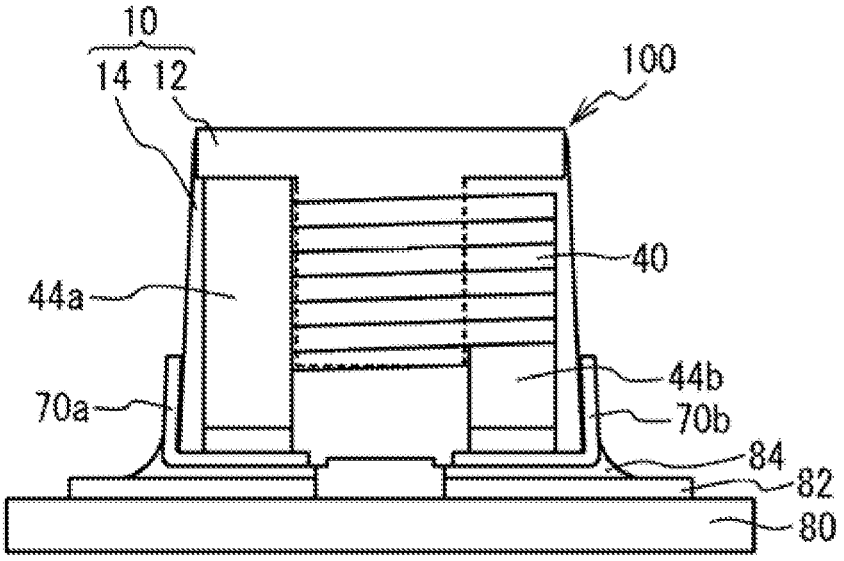

FIGS. 8A and 8B are perspective side views of the interior of the electronic device pertaining to Example 3. As shown in FIGS. 8A and 8B, the electronic device 300 in Example 3 comprises a circuit board 80, and the coil component 100 in Example 1 being mounted on the circuit board 80. The coil component 100 is mounted on the circuit board 80 as a result of its terminal parts 70*a*, 70*b* joined to the electrodes 82 on the circuit board 80 by means of a solder 84.

According to the electronic device 300 in Example 3, the coil component 100 is mounted on the circuit board 80 as a result of the terminal parts 70*a*, 70*b* of the coil component 100 joined to the electrodes 82 on the circuit board 80. This way, the coil component 100 in the obtained electronic device 300 will have improved vibration reliability. It should be noted that, although Example 3 illustrated an example where the coil component 100 in Example 1 is mounted on the circuit board 80, the coil component in Variation Example 1 of Example 1, or in Example 2, may be mounted instead.

The foregoing described examples of the present invention in detail; it should be noted, however, that the present invention is not limited to these specific examples and that various modifications and changes can be added to the extent that doing so does not deviate from the key points of the present invention as described in "What Is Claimed Is."

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2017-252520, filed Dec. 27, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component, comprising:

an element body part that is formed containing a magnetic material;

a coil that is embedded within the element body part and constituted by a wound conductive wire;

lead wires that are extended from the conductive wire and led out from the coil; and terminal parts that are metal plate members joined to the lead wires, respectively;

wherein tip parts of the lead wires, each having a prescribed length from a tip of the lead wire, are embedded in the element body part and also extend along a first face among surfaces of the element body part, the terminal parts are joined to the tip parts of the lead wires, respectively, on the first face of the element body part, wherein parts of the terminal parts positioned on the first face of the element body part are embedded in the first face of the element body part, which contains the magnetic material, and on the first face of the element body part, the terminal parts are placed entirely more outwardly than are the tip parts of the lead wires.

2. A coil component comprising:

an element body part that is formed containing a magnetic material;

a coil that is embedded within the element body part and constituted by a wound conductive wire;

lead wires that are extended from the conductive wire and led out from the coil; and terminal parts that are metal plate members joined to the lead wires, respectively;

wherein tip parts of the lead wires, each having a prescribed length from a tip of the lead wire, are embedded in the element body part and also extend along a first face among surfaces of the element body part, the terminal parts are joined to the tip parts of the lead wires, respectively, on the first face of the element body part, wherein parts of the terminal parts positioned on the first face of the element body part are embedded in a portion of the element body part, which contains the magnetic material, and on the first face of the element body part, the terminal parts are placed entirely more outwardly than are the tip parts of the lead wires, wherein the terminal parts are joined to sides of the tip parts of the lead wires along the first face of the element body part.

3. The coil component according to claim 1, wherein the lead wires are each constituted by the tip part, and a relay part between the coil and the tip part, and the tip part and relay part are both embedded in the element body part.

4. The coil component according to claim 3, wherein the relay parts of the lead wires are led out vertically to the first face of the element body part, from the coil toward the first face of the element body part.

5. The coil component according to claim 1, wherein the terminal parts extend from the first face, to a second face that intersects the first face, among the surfaces of the element body part, and are placed on an exterior of the element body part on the second face.

6. An electronic device, comprising:

the coil component according to claim 1; and a circuit board on which the coil component is mounted;

wherein the terminal parts of the coil component are joined to electrodes provided on the circuit board.

* * * * *